US006558236B2

(12) United States Patent
Donohue et al.

(10) Patent No.: US 6,558,236 B2
(45) Date of Patent: May 6, 2003

(54) METHOD AND APPARATUS FOR CHEMICAL MECHANICAL POLISHING

(75) Inventors: Timothy James Donohue, Menlo Park, CA (US); Declan Liam Brett, Santa Clara, CA (US); Gopalakrishna B. Prabhu, Sunnyvale, CA (US); Winston Y. Su, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/893,214

(22) Filed: Jun. 26, 2001

(65) Prior Publication Data

US 2003/0013384 A1 Jan. 16, 2003

(51) Int. Cl.[7] ..... B24B 1/00

(52) U.S. Cl. ..... 451/41; 451/36; 451/285; 451/307; 451/530

(58) Field of Search ..... 451/41, 285, 287, 451/307, 36, 527, 530, 534, 60

(56) References Cited

U.S. PATENT DOCUMENTS 4,059,929 A * 11/1977 Bishop
4,841,680 A * 6/1989 Hoffstein et al.
5,453,312 A 9/1995 Haas et al. ..... 428/143
5,692,950 A 12/1997 Rutherford et al. ..... 451/552
5,816,900 A 10/1998 Nagahara et al. ..... 451/285
5,916,011 A * 6/1999 Kim et al. ..... 451/41
6,012,967 A 1/2000 Satake et al. ..... 451/36
6,126,527 A * 10/2000 Kao et al. ..... 451/307
6,290,577 B1 * 9/2001 Shendon et al. ..... 451/41

OTHER PUBLICATIONS

Birang et al., "Apparatus and Methods for Chemical Mechanial Polishing with an Advanceable Polishing Sheet" U.S. Patent Application ser. No. 09/244,456, filed feb. 4, 1999.

* cited by examiner

*Primary Examiner*—Eileen P. Morgan
(74) *Attorney, Agent, or Firm*—Moser, Patterson & Sheridan

(57) ABSTRACT

Generally, a method and apparatus for polishing a substrate is provided. In one embodiment, an apparatus for polishing a substrate includes a polishing material having a fluid disposed thereon. The polishing material has a plurality of elements extending from a backing. The fluid that fills the entire volume between the elements comprising the polishing material has a viscosity between about 100 to about 10,000 centipoises. The fluid allows generation of a hydrostatic force that ensures the full and completed envelopment of fluid surrounding the fixed abrasive elements when polishing, thus substantially reducing the deformation of the elements, resulting in extended polishing material life.

29 Claims, 7 Drawing Sheets

METHOD AND APPARATUS FOR CHEMICAL MECHANICAL POLISHING

BACKGROUND OF THE DISCLOSURE

1. Field of Invention

The embodiments of the present invention generally relate to a method and apparatus polishing a substrate in a chemical mechanical polishing system.

2. Background of Invention

In semiconductor wafer processing, the use of chemical mechanical planarization, or CMP, has gained favor due to the enhanced ability to increase device density on a semiconductor workpiece, or substrate, such as a wafer. Chemical mechanical planarization systems generally utilize a polishing head to retain and press a substrate against a polishing material while providing motion therebetween. Some planarization systems utilize a polishing head that is moved over a stationary platen that supports the polishing material. Other systems utilize other motions, for example, providing a rotating platen. A polishing fluid is typically disposed between the substrate and the polishing material during polishing to provide chemical activity that assists in the removal of material from the substrate. Some polishing fluids also contain abrasives.

One type of polishing material that may be utilized for chemical mechanical polishing is known as fixed abrasive polishing material. Fixed abrasive polishing material generally comprises a plurality of abrasive particles suspended in a resin binder that is disposed in discrete elements on a backing sheet. As the abrasive particles are contained in the polishing material itself, systems utilizing fixed abrasive polishing materials generally utilize polishing fluids that do not contain abrasives. Examples of fix abrasive polishing material are disclosed in U.S. Pat. No. 5,692,950, by Rutherford et al. (issued Dec. 2, 1997) and U.S. Pat. No. 5,453,312, by Haas et al. (issued Sep. 26, 1995), both of which are hereby incorporated by reference in their entireties.

FIG. 1 generally depicts a schematic of a conventional chemical mechanical polishing apparatus 100 that utilizes a web 102 of polishing material to process a substrate 116. The apparatus 100 generally includes at least one polishing station 106. The polishing station 106 includes a polishing platen 108 and a polishing head 110. The web 102 of polishing material is supported by the platen 108 below the polishing head 110. Generally, the platen 108 has a top surface 112 that supports a polishing area 114 of the web 102 where processing occurs. The substrate 116 is retained by the polishing head 110 and pressed against the polishing area 114 while being moved relative thereto during processing.

The polishing area 114 of the web 102 is generally held against the platen 108 during processing typically by tensioning the web 102 between a supply roll 118 and a take-up roll 120 that are disposed on opposite sides of the platen 108. The top surface 112 of the platen 108 may additionally contain a groove 122 that circumscribes the polishing area 114. The groove 122 is coupled to a vacuum source 124 so that air and other fluids that may be present between the web 102 and the platen 108 are evacuated through the groove 122, thus pulling the web 102 flush against the top surface 112 of the platen 108.

Generally, the web 102 includes a plurality of abrasive elements 130 disposed on a flexible backing 132. The abrasive elements 130 have a body 134 extending from the backing 132 and terminating in a working surface 136 that contacts the surface 128 of the substrate 116.

During the processing operation, a polishing fluid 126 is disposed on the web 102. The polishing fluid 126 generally provides chemical activity that assist in the removal of material from the surface 128 of the substrate 116 being polished. Optionally, the polishing fluid 126 may include abrasives to assist in the mechanical removal of material from the surface 128 of the substrate 116. Typically, polishing fluids 126 generally have a viscosity in the range of about 0.01 to about 1.0 centipoises.

A factor in robust polishing systems and processes is controlling the cost of consumables such as the web 102 of polishing material. One factor that is detrimental to web life is deformation of the abrasive elements during polishing. Excessive deformation of the abrasive elements causes instability in substrate to substrate polishing performance (i.e., rate, uniformity, defects and the like) and ultimately results in a requirement for higher usage rates of web material per wafer processed.

During CMP processing, the substrate 116 is typically pressed against the abrasive elements 130 of the web 102 with a force of about 1.5 to about 8 psi during polishing. The relative motion between the platen 108 and the polishing head 110 results in the substrate 116 having a velocity of about 200 to about 1000 mm/sec in relation to the web 102. The loading of the substrate 116 against the web 102 and shear forces created by the relative motion between the substrate 116 and web 102 result in the abrasive elements 130 being deformed. For comparison, an abrasive element 138 depicted in a non-deformed state is shown in phantom. The deformation of the abrasive elements 130 causes non-uniform wear of the elements 130. Over successive polishing cycles, the deformation of the abrasive elements takes on a permanent deformation set. The formation of a permanent deformation set within the field of abrasive elements further aggravates the non-uniform wear of the web 102 and additionally may weaken the elements 130 to the point where some elements 130 may detach from the backing 132, resulting in substrate scratching and web 102 failure. As such, deformed elements 130 substantially contribute to an undesirable rate of web consumption during polishing and poor polishing repeatability between substrates.

The effect of mechanical stresses causing undesirable deformation of the fixed abrasive elements is amplified by the effect of heat generated during the polishing process. Heat generated during the process of substrate polishing is partially absorbed by the web matrix material. The induction of heat into the web matrix material effectively reduces the relative modulus of the abrasive matrix features. In reducing the effective modulus of the fixed abrasive matrix features, the ability of the matrix material to withstand deformation under the applied mechanical stresses of the polish process is further reduced.

The polishing fluid 126 disposed within the process area of the web 102 generally provides little benefit in preventing deformation of the abrasive elements 130. Typically, the polishing fluid 126 is generally applied to the web 102 from a central location and flows across the polishing area 114 of the web 102. Due to the polishing fluids relatively low viscosity and wetting properties, as the polishing fluid 126 spreads across the web 102, the polishing fluid 126 does not completely surround the entire abrasive elements 130, particularly in the portion of the web 102 underneath the substrate 116. Additionally, air pockets 140 may form or be trapped between some of the abrasive elements 130 that underlie the substrate 116 thus displacing the polishing fluid 126 from completely wetting out and surrounding the abrasive elements 130.

In the absence of a more complete contact of the abrasive elements by the surrounding polishing fluid two important attributes to the polishing process are not realized. The limited interaction between the polishing fluid and the abrasive elements reduces the degree to which the process fluid can provide a heat sink and conduction path in reducing the latent heat build up within the abrasive elements. The ability to reduce the latent heat build up within the abrasive elements would limit the shear modulus loss that normally would be experience, reducing the level of deformation experienced, and in general provide improved process stability. Similarly, as the polishing fluid 126 does not completely surround the abrasive elements 130, there is an absence of fluid presented at the abrasive/substrate interface during polishing 126. In the absence of sufficient lubricity being provided between the substrate and abrasive elements, localized and excessive generation of heat during polishing may be realized causing an additional mechanism for mechanical instability of the abrasive elements.

Therefore, there is a need for a method and apparatus that improves the performance of polishing material.

SUMMARY OF INVENTION

In one aspect of the invention, an apparatus for polishing is provided. In one embodiment, an apparatus for polishing a substrate includes a polishing material having a fluid disposed thereon. The polishing material has a plurality of elements extending from a backing. The fluid fills the entire volume between the elements comprising the polishing material and has a viscosity between about 100 to about 10,000 centipoises.

In another aspect of the invention, a method for polishing is provided. In one embodiment, the method includes the steps of supporting a polishing material having abrasive elements disposed on a backing, disposing a substrate on the abrasive elements of the polishing material, providing a fluid on the polishing material wherein the fluid completely fills a volume defined between the substrate and the backing, and generating a hydrostatic force between the substrate and the backing.

BRIEF DESCRIPTION OF DRAWINGS

The teachings of the present invention can readily be understood by considering the following detailed description in conjunction with the accompanying drawings in which.

To facilitate understanding, identical reference numerals have been used, wherever possible, to designate identical elements that are common to the figures.

DETAILED DESCRIPTION OF INVENTION

Figure 1:
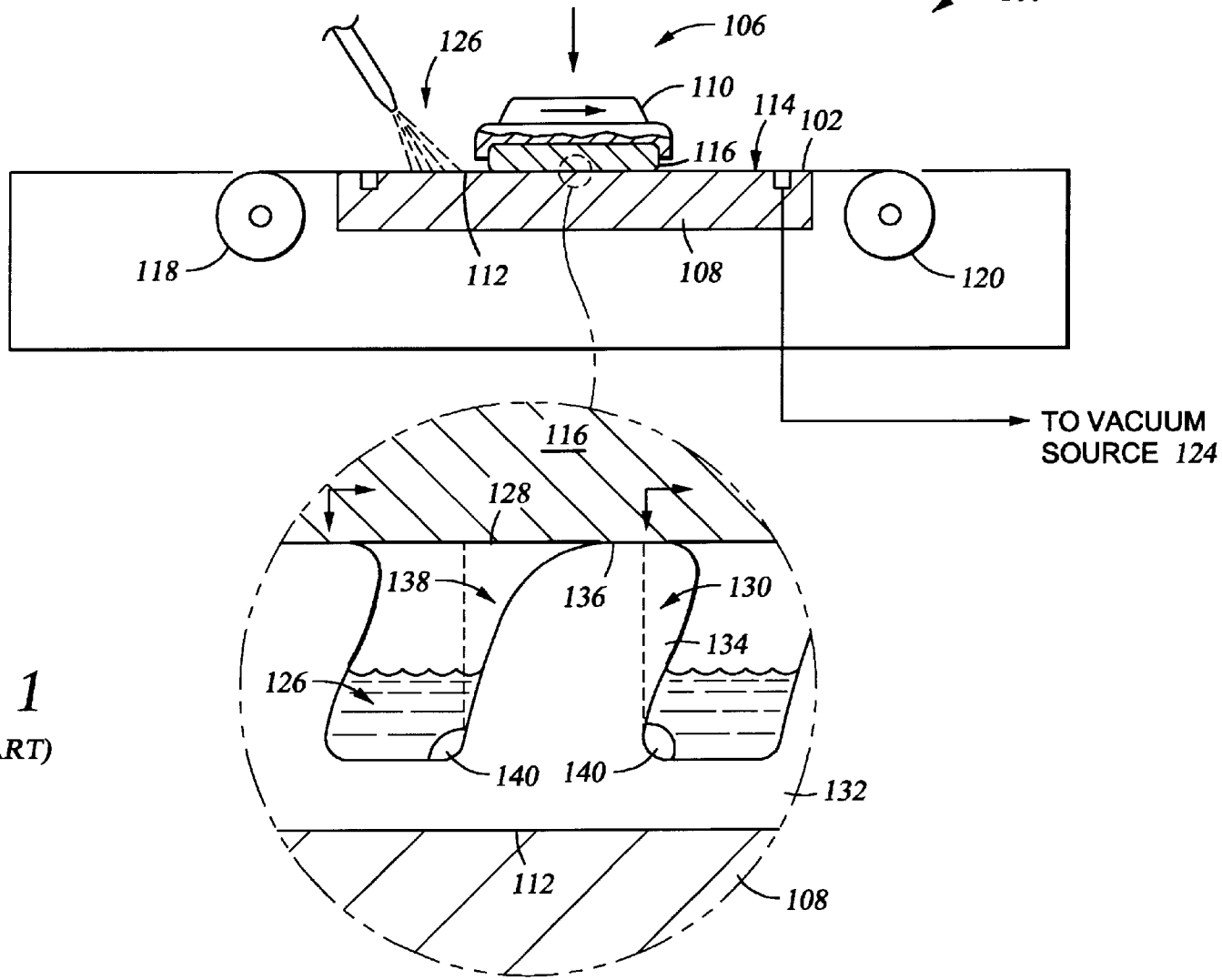
Fig. 1 (PRIOR ART)
FIG. 1 is a simplified schematic of a conventional polishing system.
Figure 2:
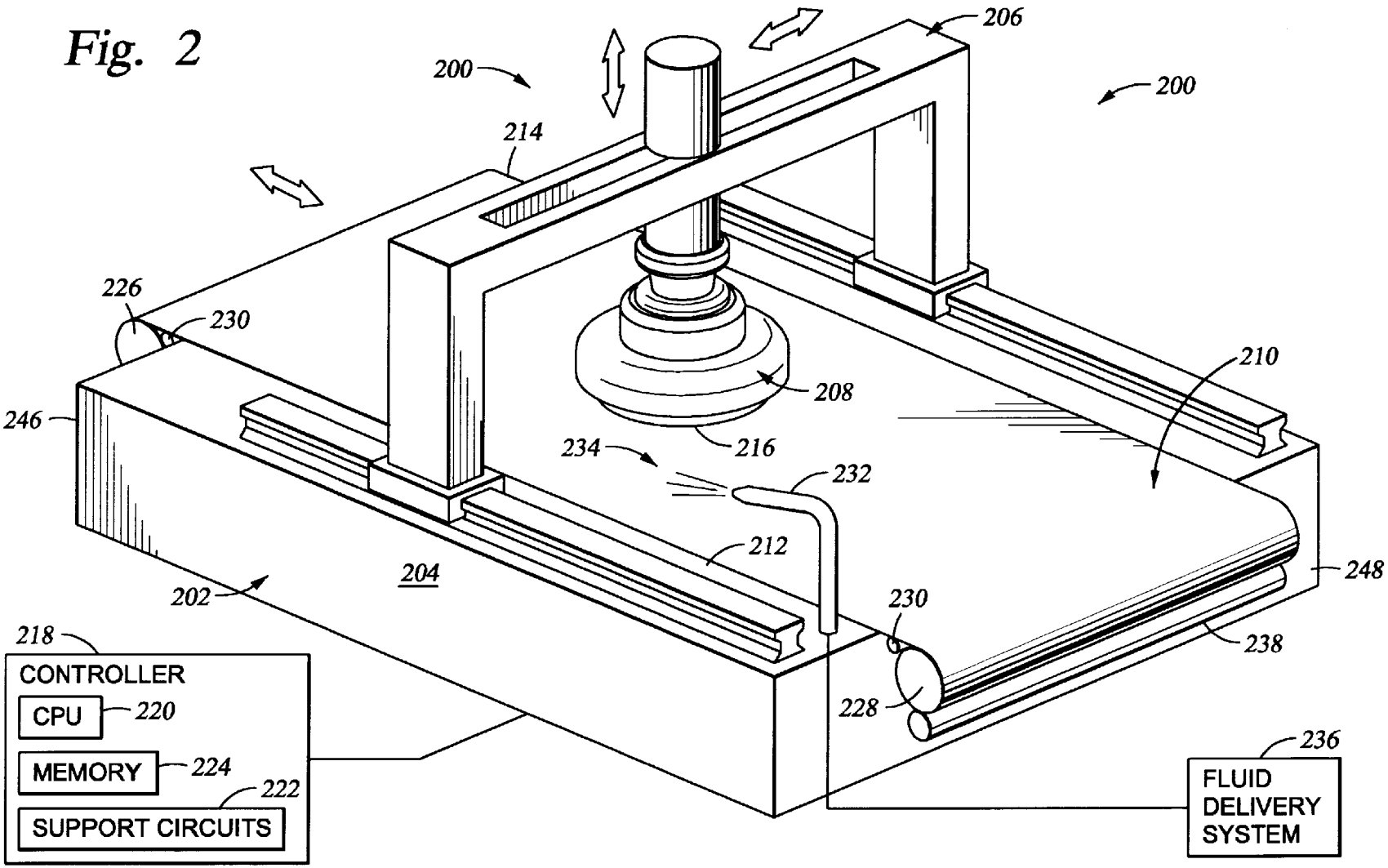
FIG. 2 is an elevation of one embodiment of a polishing station of the invention.

FIG. 2 depicts one embodiment of a polishing apparatus 200 for polishing a substrate 216 in a chemical mechanical polishing system. Two examples of a polishing apparatus which may be adapted to benefit from aspects of the invention is disclosed in U.S. Provisional Patent Application No. 60/185,812, filed Feb. 29, 2000, by Sommer, and in U.S. patent application Ser. No. 09/144,456, filed Feb. 4, 1999 by Birang, et al. Both the Sommer and Birang et al. applications are hereby incorporated by reference in their entirety. Although the invention is described in reference to an illustrative polishing apparatus 200, the invention has utility in other polishing apparatus that process substrates in the presence of a polishing fluid utilizing a polishing material comprised of a plurality of bodies extending from a backing layer.

Generally, the exemplary polishing system 200 includes a polishing table 202, a drive system 206 and a polishing head 208. One polishing system that may be adapted to benefit from the invention is described in U.S. Patent Application No. 60/185,812, filed Feb. 29, 2000 by Sommer, which is hereby incorporated by reference in its entirety. The polishing table 202 generally includes a platen 204 and a polishing material 210. The platen 204 has a top surface 212 that generally supports the polishing material 210. The platen 204 may include a subpad (not shown) disposed in the top surface 212 beneath the polishing material 210 to maintain an effective modulus of the polishing material 210, subpad and platen 204 stack at a predetermined value that produces a desired polishing result. The platen 204 is typically stationary. Alternatively, the platen 204 may move, for example, oscillating in a plane parallel to the substrate 216.

Generally, the polishing material 210 may be a pad or a web of material. In one embodiment, the polishing material 210 is in the form of a web 214 that is generally disposed across a top surface 212 of the platen 204 between a supply roll 226 and a take-up roll 228. An unused portion of the web 214 is typically stored on the supply roll 226. The supply roll 226 is coupled to a first end 246 of the platen 204. The take-up roll 228 stores an used portion of the web 214 and is generally coupled to an opposing (second) end 248 of the platen 204. Optionally, the used portion of the web 214 may be routed under the top surface 212 of the platen 204, allowing the take-up roll 228 to be situated at the first end 246 of the platen 204 near the supply roll 226. This optional configuration facilitates web replacement from a single end of the polishing table 202.

Generally, rollers 230 are disposed proximate the top surface 212 at each end 246, 248 of the platen 204 to prevent the web 214 from becoming damaged by the platen 204 when moving across the top surface 212. The supply roll 226 and the take-up roll 228 typically are coupled to drive motors (not shown) to controllably advance the web 214 therebetween.

A conditioning mechanism 238 is coupled to the polishing table 202 to prepare the unused portion of the web 214 for processing. Generally, the conditioning mechanism 238 includes a patterned or abrasive surface that planarizes the web 214 while exposing abrasive articles on the working surface of the web 214.

A polishing fluid delivery tube 232 is provided to dispense a polishing fluid 234 onto the web 214. The tube 232 is typically coupled to the polishing table 202 but may alternatively be coupled to the drive system 206 or polishing head 208. The delivery tube 232 is fluidly coupled to a polishing fluid delivery system 236. In one embodiment, the delivery system 236 regulates the flow and optionally the temperature of the polishing fluid 234 flowing through the tube 232 and onto the web 214.

The polishing fluid 234 is generally formulated to provide the chemical activity necessary to polishing a particular material disposed on the substrate 216. For example, for polishing oxides disposed on the substrate 216, the polishing fluid 234 may comprise potassium hydroxide (KOH). In other embodiments, the polishing fluid 234 may comprises Di water or other polishing fluid. The polishing fluid 234 generally has a viscosity of about 100 to about 10,000 centipoises. Optionally, the polishing fluid 234 may include a surfactant to enhance wetting of the web 214 of polishing material 210. In one embodiment, the surfactant is comprised of one ore more non-ionic surfactants. The polishing fluid 234 may additionally comprise lubricants and disbursements.

The drive system 206 is coupled to platen 204 and supports the polishing head 208 above the web 214 of polishing material. Generally, the drive system 206 provides X/Y motion to the polishing head 208 so that a substrate 216 retained in the polishing head 208 is moved in a programmed pattern while pressing the substrate 216 against the web 214 of polishing material.

The polishing head 208 may be actuated to move along an axis normal to the web 214 so that the substrate 216 may contact or be moved clear of the web 214. Examples of polishing heads that may be utilized in accordance with the invention are the DIAMOND HEAD™ wafer carrier and the TITAN™ wafer carrier, both of which are available from Applied Materials, Inc. of Santa Clara, Calif. Optionally, the polishing head 208 may include a temperature control device (not shown) to assist in regulating the temperature of the polishing process.

To facilitate process control, a controller 218 comprising a central processing unit (CPU) 220, support circuits 222 and memory 224, is coupled to the apparatus 200 and associated sources (for example, for controlling the temperature of various fluids utilized by the apparatus 200). The CPU 220 may be one of any form of computer processor that can be used in an industrial setting for controlling various drives and pressures. The memory 224 is coupled to the CPU 220. The memory 224, or computer-readable medium, may be one or more of readily available memory such as random access memory (RAM), read only memory (ROM), floppy disk, hard disk, or any other form of digital storage, local or remote. The support circuits 222 are coupled to the CPU 220 for supporting the processor in a conventional manner. These circuits include cache, power supplies, clock circuits, input/output circuitry, subsystems, and the like.

Figure 3:
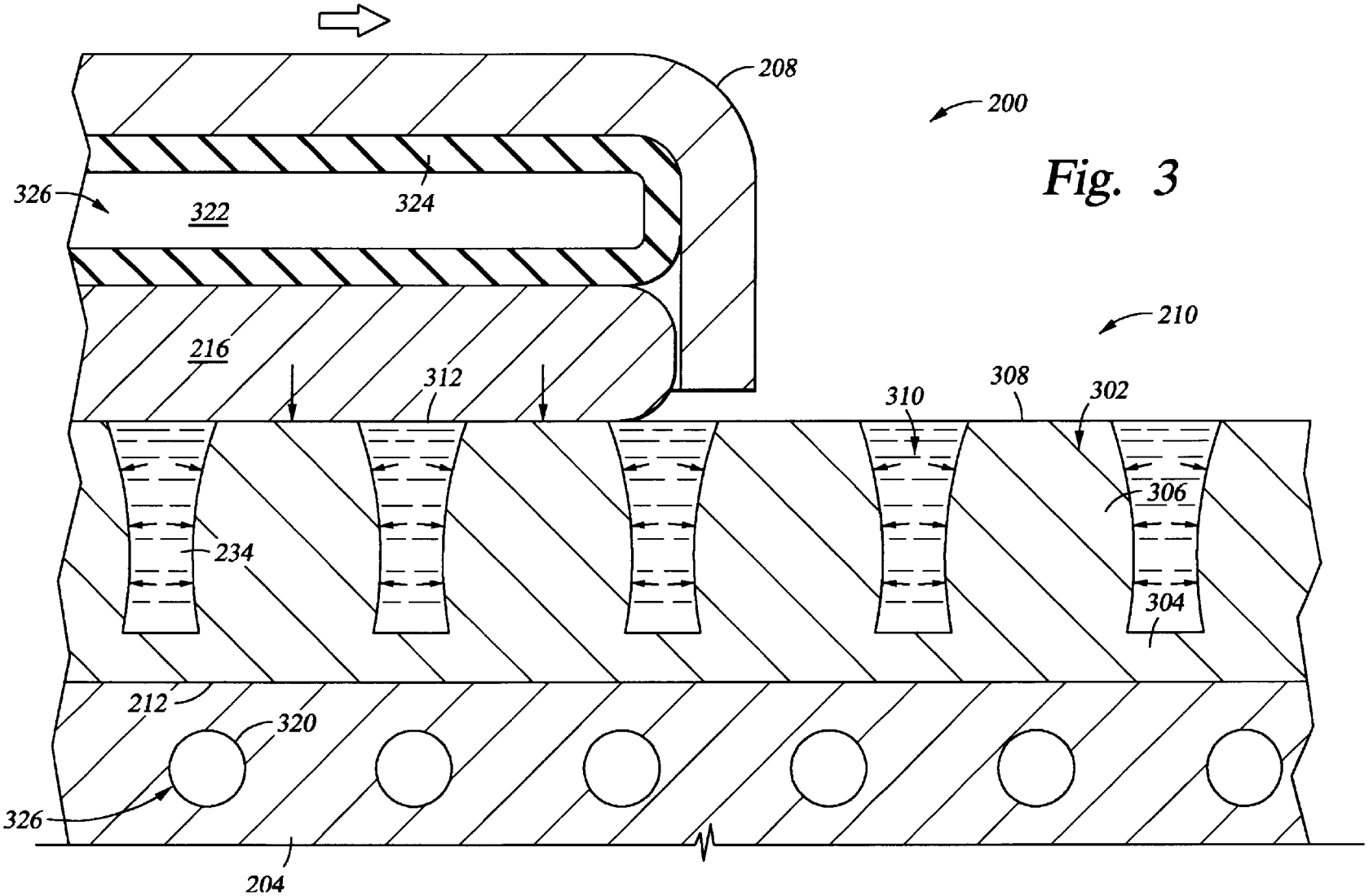
FIG. 3 is a partial sectional view of the polishing station along section line 3—3 of FIG. 2.

FIG. 3 depicts a partial cross-section of the polishing apparatus 200. Generally, the substrate 216 is depicted pressing against the web 210. The web 210 typically comprises a plurality of elements 302 disposed on a flexible backing 304. The elements 302 generally have a body 306 extending from the backing 304 and ending in a working surface 308 that contacts the substrate's lower surface 312 during polishing. An interstitial volume 310 is defined around the bodies 306 of the elements 302 between the backing 304 of the web 210 and the lower surface 312 of the substrate 226.

In one embodiment, the web 214 comprises a fixed abrasive polishing material. The fixed abrasive web 214 generally comprises a plurality of bodies 306 include a plurality of abrasive particles suspended in a resin binder. The bodies 306 are coupled to the backing 304. The backing 304 typically is a flexible polymeric material that is substantially impermeable to the polishing fluid 234 such as mylar. Optionally, the fixed abrasive material may be a pad or sheet form.

The polishing fluid 234 is disposed on the web 210 and fills the interstitial volume 310. The polishing fluid 234 completely wets out the elements 302 thus preventing the formation of air bubbles and the trapping of air between the elements 302 as the polishing fluid 234 flows therebetween. Thus, the polishing fluid 234 completely fills the interstitial volume 310 so that the interstitial volume 310 contains no air.

Moreover, as the substrate 216 is pressed against the web 210, the elements 302 deflect slightly towards the backing 304. As the deflection of the elements 302 causes the interstitial volume 310 to become smaller, a "hydrostatic" force is developed in the polishing fluid 234 between the substrate 216 and the backing 304 of the web 216. The high viscosity of the polishing fluid 234 substantially prevents the fluid from being quickly "squeezed" out from between the substrate 216 and the backing 304, thus allowing the "hydrostatic" force to rise to a level that ensures a more complete fluid interaction with the elements 302 extending through the interstitial volume 310.

Moreover, as the polishing fluid 234 completely fills the interstitial volume 310 between the substrate and web matrix backing, the polishing fluid 234 provides uniform lubricity between the substrate 216 and the elements 302 across the entire width of the substrate 216 during polishing. Development of an elevated hydrostatic pressure within the interspacial volume of polishing fluid effectively maintains the presentation of polishing fluid at the interface between the abrasive elements and substrate, providing a substantial means of removing the heat generated as a byproduct of the CMP process. With an improved polishing fluid, the generation of heat during polishing is more uniform across the web 216 as compared to conventional polishing systems resulting in enhanced polishing performance such as uniform web consumption, extended web life and better polishing uniformity.

Additionally, the polishing fluid 234 devoid of entrained air and completely surrounding the abrasive elements 302 enhances the heat transfer between the substrate 216, the abrasive elements 302 and the polishing fluid 234. The enhanced heat transfer contributes to maintaining uniform temperature across the web 216 which contributes to maintaining the mechanical stability of the abrasive elements across the web 216 during polishing resulting in more uniform polishing results.

As the rate of polishing varies with the mechanical stability and wear rate of the abrasive elements, further process stability may be realized with the added temperature control wherein the apparatus 200 may optionally be equipped with a temperature control device 326 to maintain uniform temperature during polishing. In one embodiment, the platen 204 includes one or more temperature control devices 326 disposed therein. The temperature control device 326 may comprise a plurality of passages 320 disposed proximate the top surface 212 of the platen 204 through with a heat transfer fluid is flowed. The heat transfer fluid in the passages 320 is thermally regulated to control the temperature of the polishing material 210 and polishing fluid 234. Alternatively, the temperature control devices 326 may comprise a resistive heater or other heat sources such as a lamp disposed proximate or within the platen 204. In another embodiment, the temperature control device 326 may be disposed in the polishing head 208. For example, the head 208 may include a bladder 324 disposed proximate the substrate 216. A fluid 322 pressurizing the bladder 324 is thermally controlled to control the temperature of the substrate 216 and polishing fluid 234. In another embodiment, the temperature of the polishing fluid 234 may be regulated by the polishing fluid delivery system 236.

Figure 4A:
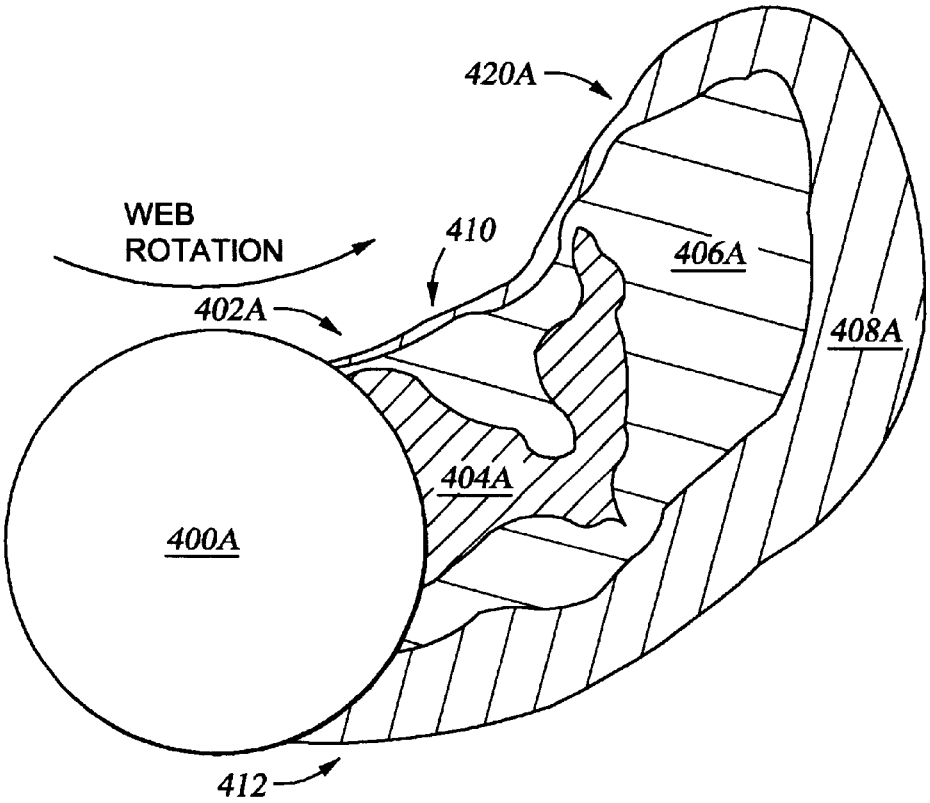
FIGS. 4A–4B are a comparison of temperature distributions on polishing pads using conventional polishing fluids and the inventive polishing fluid.
Figure 4B:
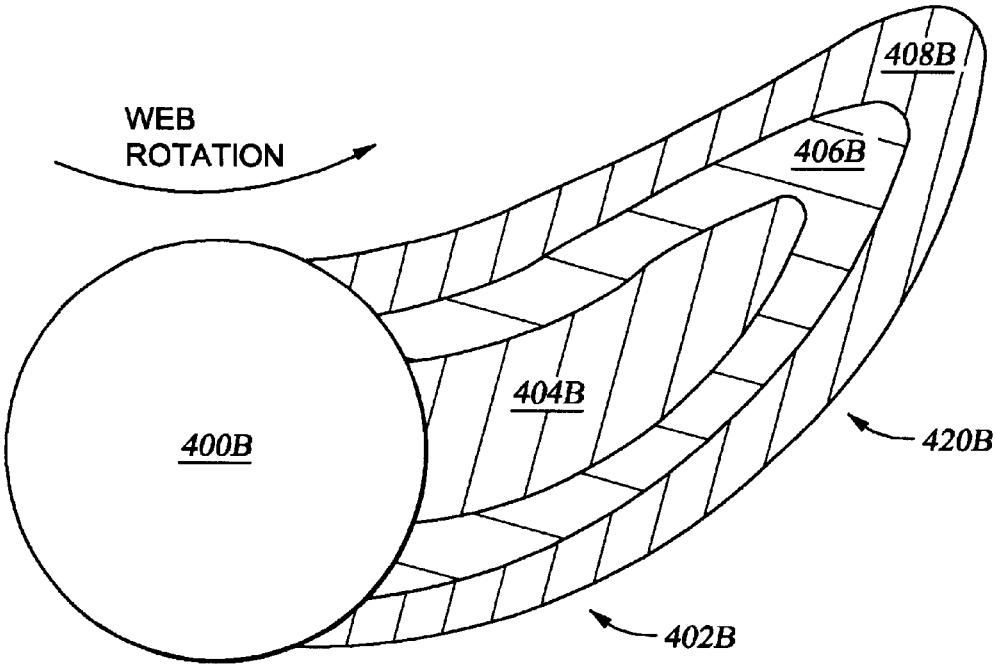
Figure 5:
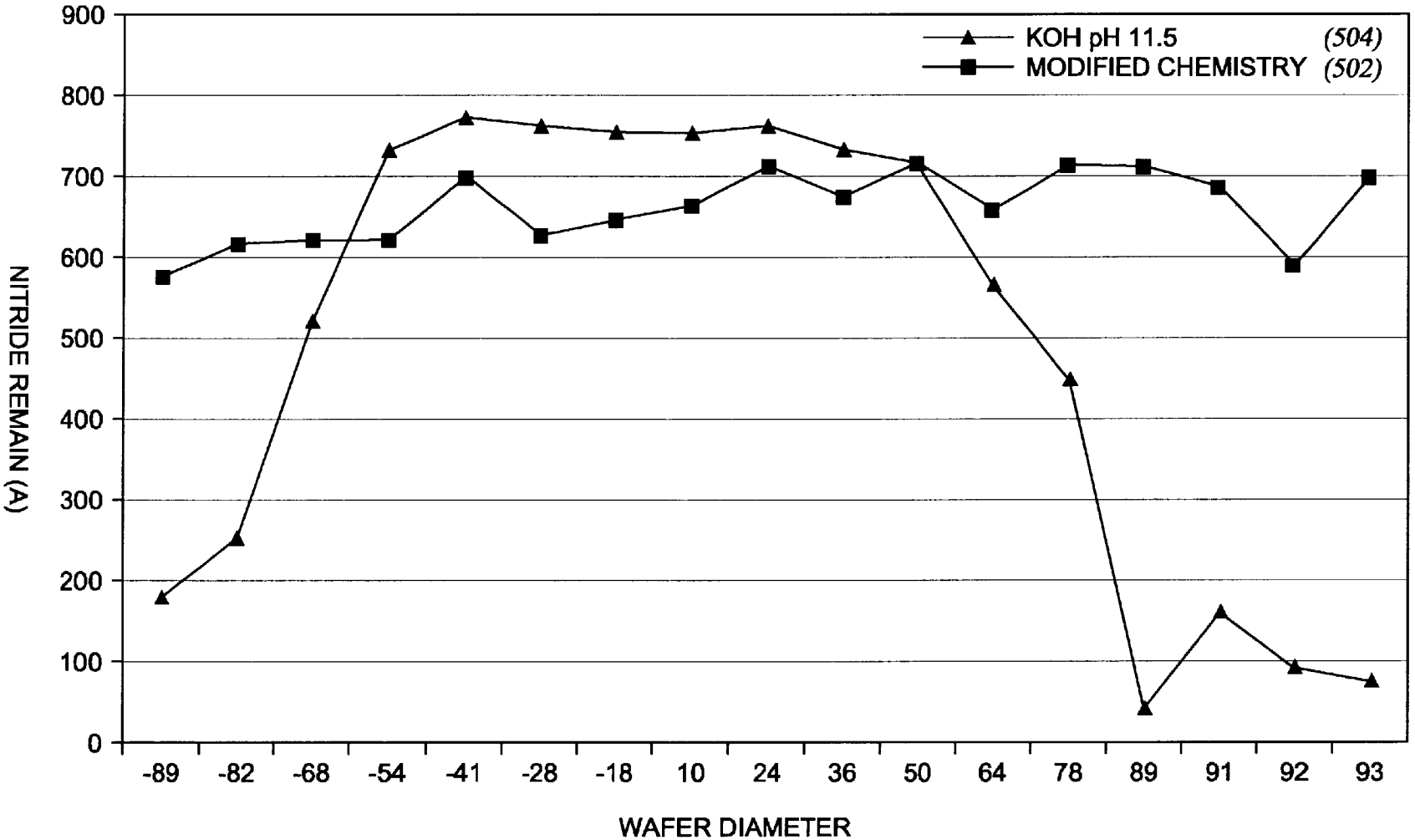
FIG. 5 is a graph depicting a comparison of polishing uniformity across a single substrate diameter.

For example, FIGS. 4A and 4B depict a comparison of temperature distribution across a polishing pad during conventional polishing and polishing according to the invention. FIG. 4A illustrates the substrate 400A disposed on a rotating fixed abrasive pad 402A. A conventional polishing fluid as previously characterized is between on the pad 402A and substrate 400A. The pad 402A, being unsupported by the polishing fluid and having a non-uniform distribution of polishing fluid 234 thereunder, contacts the substrate 400A non-uniformly. The non-uniformity causes a temperature gradient 420A to be present on the pad 402A under the substrate during polish as evidence by the temperature profile of the pad downstream of the substrate 400A. The gradient 420A is characterized by a higher temperature center section 404A surrounded by an intermediate temperature section 406A and an outer, low temperature section 408A. As illustrated, the temperature gradient 420A on the unsupported pad 402A has a non-uniform distribution, particularly at the portions 410 and 412 of the pad 402A over which the edges of the substrate 400A are polished. The polishing uniformity results 504 of the conventional polish are poor as depicted in the graph of FIG. 5.

FIG. 4B illustrates the substrate 400B disposed on a rotating fixed abrasive pad 402B. A high viscosity polishing fluid 234 as previously characterized above is between on the surface of the abrasive elements 402B and substrate 400B. As the polishing fluid 234 has no entrained air, the abrasive elements 402B contacts the substrate 400B more uniformly and with less friction as compared to conventional polishing. Additionally, the uniform distribution of the polishing fluid 234 around the abrasive elements 230 provides good heat transfer therebetween, creating thermal uniformity across the pad 402B. The uniformity of lubricity, heat transfer and generation causes an even temperature gradient 420B to be present on the pad 402B underneath the substrate 400B as evidenced by the temperature profile on the pad 402B downstream of the substrate 400B. The gradient 420B is characterized by a higher temperature center section 404B surrounded by an intermediate temperature section 406B and an outer, low temperature section 408B. As illustrated, the temperature gradient 420B on the hydrostatically supported pad 402B has a more uniform distribution with a reduction in maximum level of temperature that would normally be developed. The polishing uniformity results 502 of the pad 402B having the fluid 234 disposed thereon yields superior polishing results compared to the results 504 of the conventional polish as depicted in the graph of FIG. 5.

Figure 6:
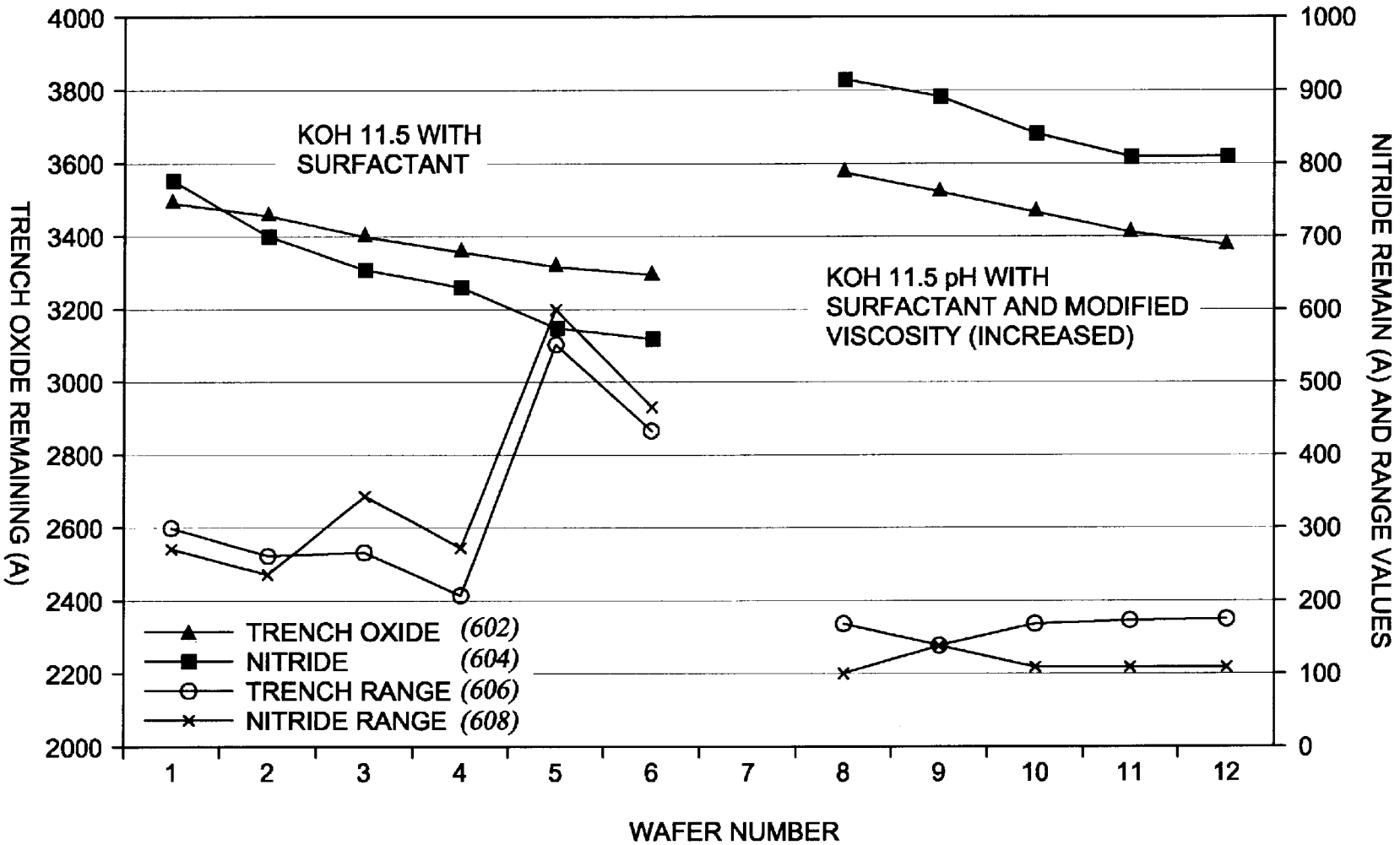
FIG. 6 is a graph depicting a comparison of substrate to substrate polishing uniformity.

FIG. 6 is a graph depicting a comparison of substrate to substrate polishing uniformity. Trench Oxide 602 and Nitride 604 polishing uniformity is depicted over a series of substrates having undergone conventional polishing. Trench Range 606 and Nitride Range 608 polishing uniformity is depicted over a series of substrates having undergone conventional polishing. As illustrated, the Trench Range 606 and Nitride Range 608 polishing uniformity depicted illustrates disadvantageous variation substrate to substrate.

Trench Oxide 602 and Nitride 604 polishing uniformity is depicted over a series of substrates having undergone hydrostatically supported polishing. Trench Range 606 and Nitride Range 608 polishing uniformity is depicted over a series of substrates having undergone polishing in the presence of the high viscosity polishing fluid 234. As illustrated, the Trench Range 606 and Nitride Range 608 polishing uniformity depicted illustrates little variation substrate to substrate, particularly as comprised to conventional Trench Range 606 and Nitride Range 608 polishing uniformity. The Trench Oxide 602 and Nitride 604 uniformity generally was comparable to conventional results.

Figure 7:
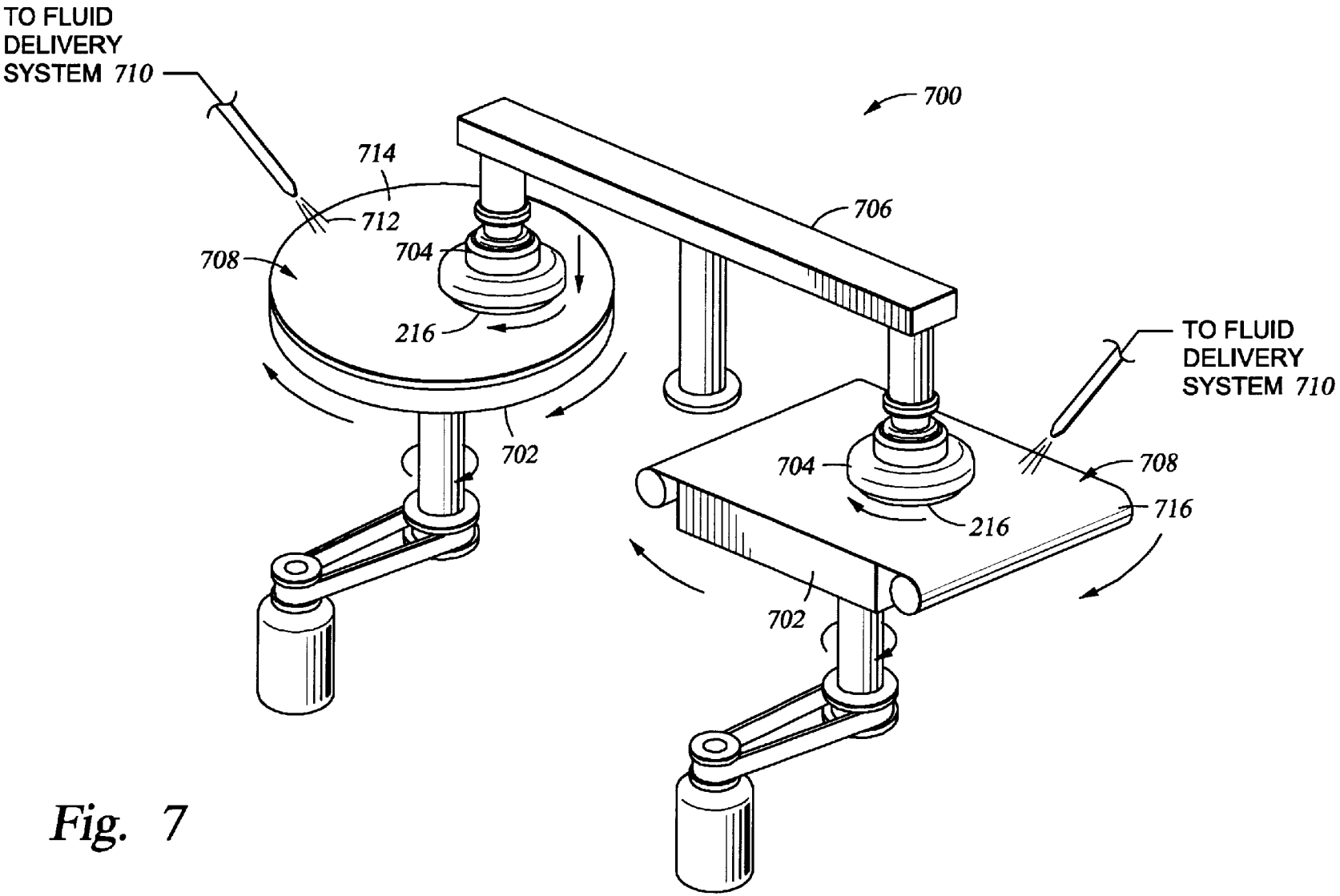
FIG. 7 is an elevation of another embodiment of a polishing station.

FIG. 7 depicts another embodiment of a polishing apparatus 700 in which the invention may be practiced. The polishing apparatus 700 generally includes a rotating platen 702 and a polishing head 704 supported above the platen 702 by a carousel 706. Generally, the platen 702 supports a polishing material 708 that includes a plurality of elements extending from a backing layer. The polishing material 708 may be a web or a pad, and may include abrasive particles disposed therein.

The apparatus includes a polishing fluid delivery system 710 that provides a polishing fluid 712 to the polishing material 708 as described above with reference to FIG. 2. The polishing fluid 712 is substantially identical to the polishing fluid 234 described above. The polishing fluid 712 and polishing material 708 interact during processing as to provide both enhanced lubricity and heat transfer that extends the life of the polishing material 708 and improves polishing quality.

Although the teachings of the present invention that have been shown and described in detail herein, those skilled in the art can readily devise other varied embodiments that still incorporate the teachings and do not depart from the scope and spirit of the invention.

What is claimed is:

1. Apparatus for polishing a substrate in a chemical mechanical polishing system comprising:

a platen;

a polishing material supported on the platen and having a plurality of elements extending from a backing, the elements having a volume defined therebetween; and a fluid disposed on the polishing material and entirely filling a portion of the volume that is disposed under the substrate, the fluid having a viscosity between about 100 to about 10,000 centipoises.

2. The apparatus of claim 1, wherein the plurality of elements comprise a plurality of abrasive particles held in a polymeric binder.

3. The apparatus of claim 2, wherein the plurality of elements further comprise:

a base coupled to the backing; and a top polishing surface opposite the base, and wherein the fluid filling the portion of the volume is co-planar to the top polishing surface.

4. The apparatus of claim 2, wherein the fluid further comprises a portion underlying the substrate that is at a pressure greater than a portion of the fluid not disposed under the substrate.

5. The apparatus of claim 2, wherein the fluid further comprises a portion underlying the substrate that contains no air bubbles.

6. The apparatus of claim 1, wherein the fluid further comprises potassium hydroxide.

7. The apparatus of claim 1, wherein the fluid further contains a surfactant.

8. The apparatus of claim 7, wherein the surfactant is non-ionic.

9. The apparatus of claim 1, wherein the polishing material is a web or pad.

10. The apparatus of claim 1, further comprising:

means for advancing the polishing material to expose an unused portion of the polishing material.

11. Apparatus for polishing a substrate in a chemical mechanical polishing system comprising:

a platen;

a polishing material supported on the platen having a plurality of elements extending from a backing; and a fluid disposed on the polishing material, the fluid having a viscosity between about 100 to about 10,000 centipoises;

a polishing head adapted to press the substrate against the polishing material, wherein the polishing material and polishing head have a motion relative to each other to facilitate polishing, wherein the plurality of elements define a void therebetween, the fluid filling the void.

12. The apparatus of claim 11, wherein the platen rotates.

13. The apparatus of claim 11 further comprising a drive system coupled to the polishing head, wherein the drive system moves polishing head in a plane parallel to the polishing material.

14. The apparatus of claim 11, wherein the plurality of elements further comprise:

a base coupled to the backing; and a top polishing surface opposite the base, and wherein the fluid filling the void is co-planar to the top polishing surface.

15. The apparatus of claim 11, wherein the fluid further comprises a portion underlying the substrate that is at a pressure greater than a portion of the fluid not disposed under the substrate.

16. The apparatus of claim 11, wherein the fluid further comprises a portion underlying the substrate that contains no air bubbles.

17. The apparatus of claim 11, wherein the fluid further comprises potassium hydroxide.

18. The apparatus of claim 11, wherein the fluid further contains a surfactant.

19. The apparatus of claim 18, wherein the surfactant is non-ionic.

20. The apparatus of claim 11, wherein the polishing material is a web or pad.

21. The apparatus of claim 11, further comprising means for advancing the polishing material to expose an unused portion of the polishing material.

22. A method for polishing a substrate in a chemical mechanical polishing system comprising:

supporting a polishing material having abrasive elements affixed to and extending upwardly from a backing defining a volume therebetween;

disposing a substrate on the abrasive elements of the polishing material, thereby enclosing a portion of the volume between the substrate, the backing, and the abrasive elements;

providing a fluid on the polishing material having a viscosity between about 100 to about 10,000 centipoises, the fluid substantially filling the volume; and pressing the substrate against the abrasive elements, thereby generating a hydrostatic force in the fluid between the substrate and the backing.

23. The method of claim 22 further comprising:

eliminating air between the substrate and the backing.

24. The method of claim 22, wherein the providing step wets the entire surface of the abrasive element exposed between substrate and the backing.

25. The method of claim 22 further comprising moving the substrate in relation to the polishing material.

26. The method of claim 22 further comprising moving the polishing material between a supply roll having an unused portion of the polishing material disposed thereon and a take-up roll having an used portion of the polishing material disposed thereon.

27. The method of claim 22, wherein the step of supporting the polishing material further comprises retaining a pad of polishing material to a platen.

28. The method of claim 22, further comprising the step of advancing the polishing material periodically to expose an unused portion of the polishing material.

29. A method for polishing a substrate in a chemical mechanical polishing system comprising:

supporting a polishing material having abrasive elements affixed to and extending upwardly from a backing defining a volume therebetween;

disposing a substrate on the abrasive elements of the polishing material, thereby enclosing a portion of the volume between the substrate, the backing, and the abrasive elements;

providing a fluid on the polishing material wherein the fluid completely fills the volume, wherein the fluid has a viscosity between about 100 to about 10,000 centipoises; and pressing the substrate against the abrasive elements, thereby generating a hydrostatic force in the fluid between the substrate and the backing.

* * * * *